United States Patent [19]

Kono

[11] 4,307,878

[45] Dec. 29, 1981

[54] CASSETTE TYPE FEED APPARATUS

[75] Inventor: Tateomi Kono, Toyokawa, Japan

[73] Assignee: Minolta Camera Kabushiki Kaisha, Osaka, Japan

[21] Appl. No.: 126,820

[22] Filed: Mar. 3, 1980

[30] Foreign Application Priority Data

Mar. 6, 1979 [JP] Japan ..... 54-026544

[51] Int. Cl.[3] ..... B65H 3/30

[52] U.S. Cl. ..... 271/22; 271/127; 271/160

[58] Field of Search ..... 271/160, 162, 164, 21, 271/9, 22, 126, 127

[56] References Cited

U.S. PATENT DOCUMENTS 4,007,925 2/1977 De Ryke ..... 271/160

4,221,375 9/1980 Morrison ..... 271/160 X

FOREIGN PATENT DOCUMENTS 52-37500 3/1977 Japan ..... 271/160

*Primary Examiner*—Richard A. Schacher

*Attorney, Agent, or Firm*—Wolder, Gross & Yavner

[57] ABSTRACT

A paper feed mechanism employing interchangeable cassettes having liftable paper stack support plates and containing different size paper sheets includes a feed roll engaging the uppermost sheet of an operatively positioned cassette, a lifting member separably engaging the support plate and a spring system biasing the lifting member and adjustable under the control of an indexing member on the operative cassette to adjust the bias in accordance with the paper size so that the pressure of the feed roll in the uppermost sheet is constant and independent of paper size. The spring system may include a first spring which is operable with all sizes of paper sheet and a second spring which is enabled only when the cassette contains large sheets and biases the lifting member with the first spring.

6 Claims, 10 Drawing Figures

CASSETTE TYPE FEED APPARATUS

The present invention relates generally to improvements in paper sheet feed mechanisms and it relates particularly to an improved mechanism for feeding successive individual sheets from the top of a stack of the sheets which is contained in a replaceable cassette and is supported on a plate in the cassette which is raised to bring the uppermost or first sheet into engagement with feed rollers located in the machine accommodating the cassette.

Paper feed mechanisms of the subject type are generally provided with means for preventing the feed rollers from retracting and feeding more than one sheet at a time and are described, for example, in U.S. Pat. No. 3,689,064, entitled "PAPER FEED ARRANGEMENT," granted to Henry R. Kuksae, and based on an application filed May 5, 1969. While the uppermost sheet (hereinafter referred to as "the first sheet") in contact with the feed rollers frictionally engages the next underlying sheet (hereinafter referred to as "the second sheet"), the paper accommodating means for the apparatus is usually provided with corner separators or rubber plates at the forward corners of the stack of sheets to impart to the second sheet a resisting force which is greater than the frictional force between the first and second sheets and thereby prevent withdrawal of the second sheet when the first sheet is emitted.

If the contact force between the first sheet and the feed rollers, namely, the feed pressure of the rollers exerted on the first sheet is excessive, the frictional force between the first and second sheets is also high and if such frictional force exceeds the resisting force on the second sheet, the second sheet will be retracted or withdrawn with the first sheet. Consequently, the feed pressure of the rollers must be set at a proper value.

In order to set the feed rollers at the proper feed pressure, the paper support plate is conventionally raised by a constant force afforded by a spring. However, when the size of the sheets is changed by the replacement of the cassette, the resulting variation in the weight of the paper alters the feed pressure. Consequently, if the cassette contains sheets of relatively low weight, an increased feed pressure results, with the feed of more than one sheet at a time occurring, whereas an increase in the weight of paper entails a reduced feed pressure and leads to an unsteady and unreliable feed operation. This phenomenon becomes more pronounced with increasing differences in weight between sheets of different sizes.

Thus, the cassette type paper feed mechanisms of the type with a liftable paper support plate, unlike those having downwardly movable feed rollers, are not suitable for use with cassettes which accommodate sheets of paper other than those within a predetermined narrow weight range.

SUMMARY OF THE INVENTION

It is a main object of the present invention to provide an improved paper sheet feed mechanism for use with a replaceable cassette having a liftable paper support plate and accommodating paper sheets of different weights and in which the paper feed rollers are always maintained at a constant feed pressure independent of the weight of the sheets contained in the cassette.

Another object of the present invention is to provide a cassette type paper feed mechanism in which the cassettes per se are provided with means for adjusting the feed pressure, such that the sheets of paper contained in a particular cassette are feedable at a proper pressure merely with the loading of the apparatus with a cassette.

Still another object of the present invention is to provide a cassette type paper feed mechanism having incorporated therein a primary spring and a secondary spring so as to effect a variable lifting force in accordance with the size of the paper sheets by enabling only the primary spring to act in the presence of light sheets while enabling both the primary and secondary springs to act cooperatively in the presence of heavier sheets.

The above and other objects of the present invention will become apparent from a reading of the following description taken in conjunction with the accompanying drawings which illustrate a preferred embodiment thereof.

Specifically, a paper feed mechanism, according to the present invention, is loadable with a cassette having a paper support plate in its main body and accommodating sheets of paper stacked on the support plate and in which the paper support plate is liftable to press the stack of sheets against feed rollers, the mechanism is characterized by a lifting member for raising the paper support plate, biasing means for imparting a lifting force to the lifting member, and adjusting means for varying the force of the biasing means in accordance with the weight of the stack of sheets on the paper support plate, whereby the pressing force exerted on the feed rollers is maintained at an approximately constant value with different weights of the sheets of paper in the stack on the paper support plate.

DESCRIPTION OF THE PREFERRED EMBODIMENT

Figure 1A:
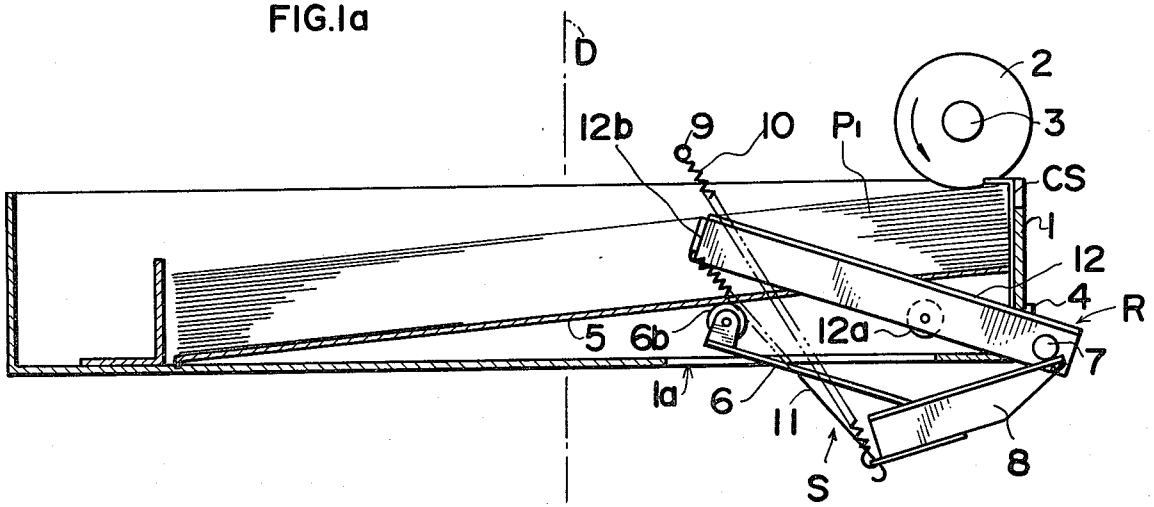
FIG. 1*a* is a side elevational view, partially in section of a paper feed mechanism in accordance with the present invention shown with a cassette loaded with a stack of small paper sheets.

Referring now to the drawings which illustrate a preferred embodiment of the present invention, feed rollers 2 mounted on a drive shaft 3 fixedly positioned on the main body D of an apparatus to which the present mechanism is applied are rotatable in the direction of the arrow in response to a feed signal in a well known manner. A cassette 1 is separably and replaceably disposed and retained in a predetermined position in the apparatus by a stop 4 attached to the main body and by a click means M hereinafter described. The cassette 1 is provided in its interior with a vertically tiltable or liftable paper support place 5 having located thereon a stack of paper sheets P1 of small size or paper sheets P2 of a large size. Frictional rubber plates not shown, are affixed to guide means for the cassette 1 and to the paper support plate 5 in the known manner, and corner separators CS are disposed at the forward corners of the stack of sheets.

A lifting member defining angular arm 6 (see FIG. 5*a*) has its inner end or base portion 6*a* fixed to a rod 7 rotatably mounted on the apparatus main body and carries at its forward end a roller 6*b* which is movable into the cassette 1 through a bottom opening 1*a* (see FIG. 1*a*) to lift the paper support plate 5. Biasing means S for urging the lifting member 6 in the lifting direction, namely, upward as shown, includes a primary spring 10 having one end attached to a pin 9 fixed to the main body and the other end attached to a spring holder arm 8 secured at its base portion or inner end to the rod 7. The spring 10 is of such strength as to impart a predetermined feed pressure to sheets P1 of small size toward rollers 2. With the arrangement shown in FIG. 1*a* in which the cassette 1 disposed in operative position contains a stack of sheets P1, only the spring 10 urges the roller 6*b* on the lifting member 6 to raise the paper support plate 5 thereby to press the first sheet P1 against the feed rollers 2, which in turn feed the sheets P1 one after another from the uppermost position by the rotation thereof.

Figure 5A:
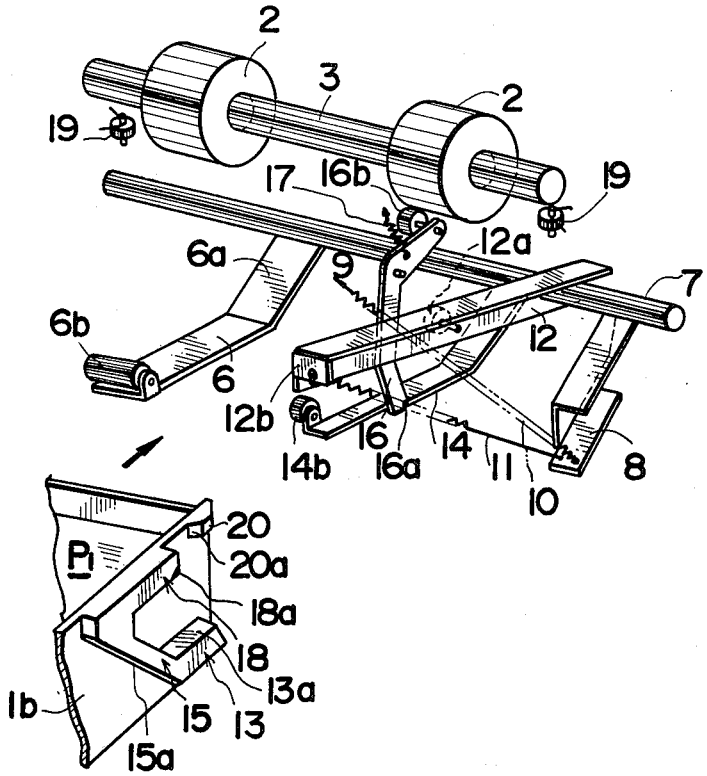
FIG. 5*a* is a fragmentary perspective view of the mechanism showing the cassette in a partially inserted condition.

While the construction described above is similar to that of conventional apparatus of the subject type, the lifting member 6 of the mechanism according to the present invention functions to exert a lifting force which is variable in accordance with the combined weight of the paper support plate 5 and the stack of sheets of the preselected size disposed on the plate so as to impart a predetermined specific feed pressure at all times. For this purpose, the biasing means S further includes a secondary spring 11 which coacts with the primary spring 10 when paper sheets P2 of the larger size is used to afford the predetermined specific feed pressure. The secondary spring 11 extends from the holder arm 8 to a control member R which is controlled according to the size of sheets and which comprises a spring adjusting member defining arm 12 swingably supported at its inner end or base portion on and about the rod 7. The secondary spring 11 extends from the outer end of holder 8 to the forward end 12*b* of the spring adjusting member 12 (see FIGS. 5*a* and *b*). As seen in FIGS. 1*b*, 3*b* and 5*a*, a side wall or plate 1*b* of the cassette 1 is provided with a respective selecting member 13 or 13' for controlling the position of the spring adjusting member 12 to impart a biasing force suitable for the corresponding sheets P1 or P2. With the cassette 1 in its installed or operative position, the selecting member 13 or 13' holds a roller 12*a* on the spring adjusting member 12 in a raised position. The change of this position specifically the height thereof, therefore selectively shifts the spring adjusting member 12 to the position suited to the sheets P1 or P2 contained in the respective installed cassette.

Figure 1B:
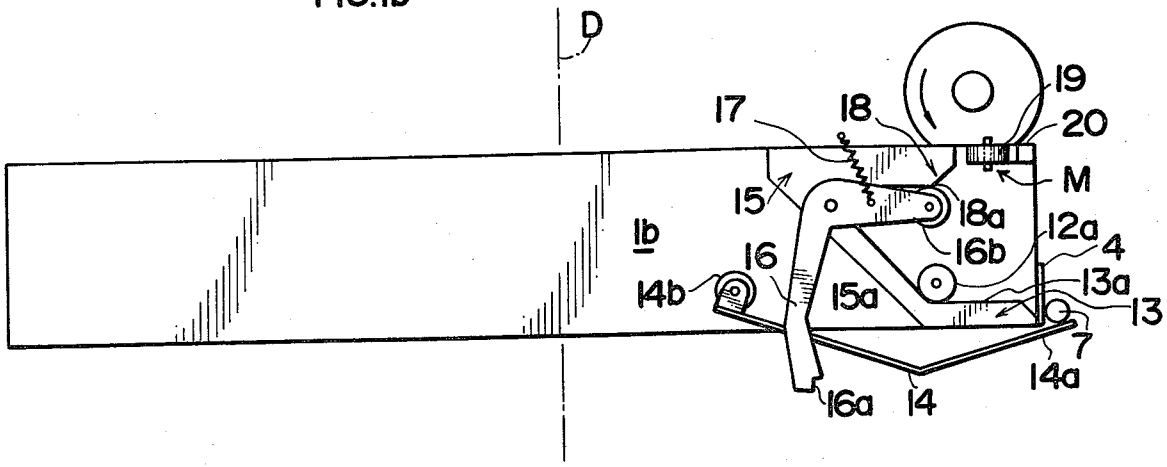
FIG. 1*b* is a side elevational view thereof.

With the cassette shown in FIGS. 1*a* and *b* accommodating the sheets P1 of smaller size, the selecting member 13 on the cassette side plate 1*b* has a cam face 13*a* so positioned that the secondary spring 11 is disabled and will not act. Because the position of the cam face 13*a* is low, the adjusting member 12 is not raised to a high level, and the secondary spring 11 is not tensioned the spring holder 8 is not pulled. Consequently, the lifting member 6 presses the first sheet P1 against the feed rollers 2 under the influence of the lifting force afforded by the primary spring 10 alone.

Figure 3A:
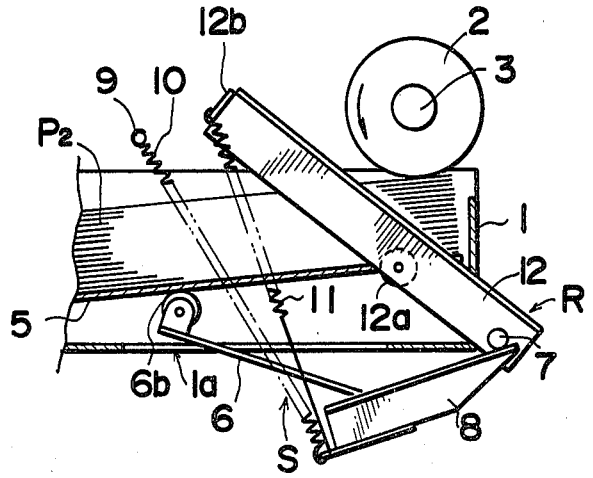
FIG. 3*a* is a fragmented view similar to FIG. 1*a,* but with a cassette loaded with a stack of large paper sheets.
Figure 3B:
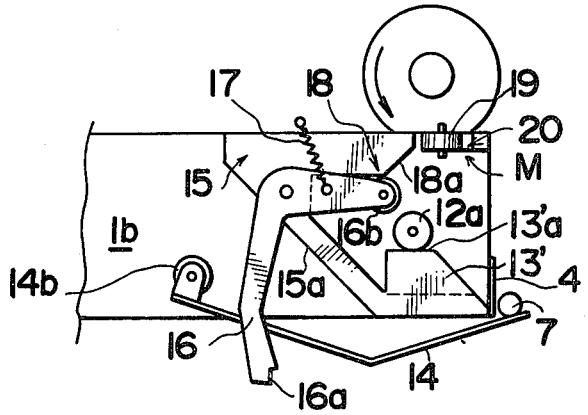
FIG. 3*b* is a side elevational view thereof.

On the other hand, with the cassette 1 shown in FIGS. 3*a* and *b* and containing or accommodating the sheets P2 of large size, the selecting member 13' on the cassette plate 1*b* had a cam face 13'*a* at a high level for raising the roller 12*a* of the adjusting member 12 to tension, enable and cause the secondary spring 11 to bias the holder 8. As a result, the lifting member 6 presses the first sheet P2 under the influence of the lifting force provided by the combined force of both the primary spring 10 and the secondary spring 11.

Thus, according to the illustrated embodiment, the feed rollers 2 are caused to exert a proper feed pressure on the sheets P1 of smaller size under the influence of the primary spring 10, while the reduction in the feed pressure of the feed rollers 2 on the sheets P2 of large size due to their greater weight is compensated for by the force of the secondary spring 11, whereby the feed pressure is maintained at a constant level at all times for papers of different weights.

Figure 4:
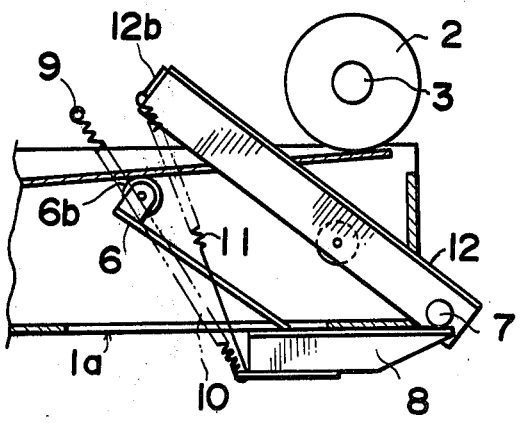
FIG. 4 is a view similar to FIG. 3*a,* but with the stack of paper depleted.
Figure 6:
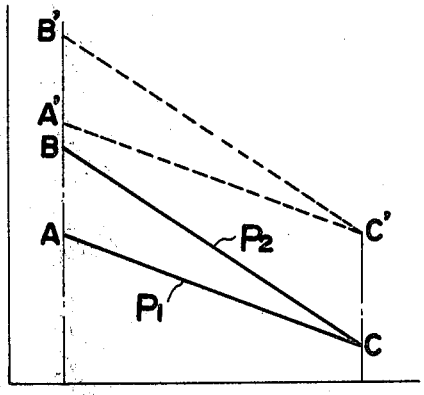
FIG. 6 is a graph showing the variation of the weights of stacks of different size sheets with decreases in the number of sheets.

Considering now the biasing forces of the springs 10 and 11 in detail, FIG. 6 shows the variation in the weight acting on the roller 6*b* of the lifting member 6 with the decrease in the number of sheets in the stack when the above described apparatus is loaded with stacks of sheets of different sizes. A is the weight acting on the roller 6*b* when the apparatus is loaded with a stack of sheets P1 of small size (FIG. 1*a*), B is the weight on the roller 6*b* when the apparatus is loaded with a stack of sheets P2 of large size (FIG. 3*a*), and C is the weight of the paper support plate 5 in the absence of sheets P1 or P2 (FIG. 2*a* or FIG. 4), the weight of the plate 5 being assumed to be the same for the sheets P1 and P2. The variation in the weight acting on the roller 6*b* from the initial fully loaded state until the depletion or completion of delivery of the sheets is represented by a line AC for the sheets P1 of small size and by a line BC for the sheets P2 of large size. Lines A'C' and B'C' represent the required upward forces for achieving the optimum feed pressure for both cases. Accordingly, the improved mechanism is so controlled that the primary spring 10 affords the force represented by the line A'C' for the cassette 1 containing the sheets P1 of small size and that the secondary spring 11 exerts such a force as to change the line A'C' to the line B'C' in the case where the cassette 1 contains or accommodates the sheets P2 of large size. This assures a constant feed pressure for both small and large sizes at all times.

Figure 2A:
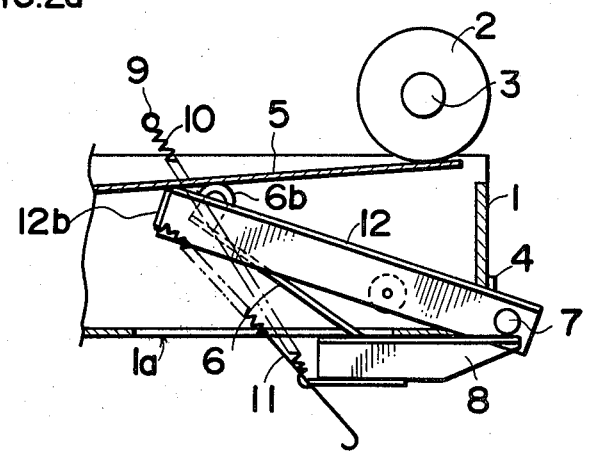
FIG. 2*a* is a fragmented view similar to FIG. 1*a* but with the paper being fully depleted.

In order to retract the lifting member 6 from the installed position of the cassette 1 against the action of the biasing means S when the cassette 1 is to be removed from the main body, there is provided a retracting means which includes a retracting member defining arm 14 positionable close to the outside face of side wall 1*b* of the cassette 1 and having a base portion of inner end 14*a* affixed to the rod 7 and a follower roller 14*b* at its free forward end (see FIG. 5*a*), and a depressing member 15 for depressing the roller 14*b* on the retracting member 14 to a retracted position with the withdrawal of the cassette 1. As shown in FIG. 5*a*, the retracting member 14 is similar to the lifting member 6. The depressing member 15 is located on the outside face of the side wall 1*b* of the cassette 1*a* and has a slanting cam face 15*a* in engagement with the roller 14*b* on the retracting member 14 for depressing the roller 14*b* to its retracted position as seen in FIG. 2*a* with the retraction of the cassette.

Retaining means for releasably holding the lifting member 6 in its retracted position after the member 6 has been retracted by the retracting means includes an angular latch lever 16 pivoted at its elbow and having at one end a corner notched engaging portion 16*a* for latching the retracting member 14 in a retracted position and a spring 17 for biasing the lever 16 into engagement with the member 14, as seen in FIGS. 5*a* and *b*. Means for releasing the retracting member 14 from the latch lever 16 comprises a release member 18 for engaging and depressing a roller 16*b* on the end of the latch lever 16 opposite engaging portion 16*a* against the action of the spring 17 to disengage the engaging portion 16*a* of the latch lever 16 from the retracting member 14 as illustrated in FIG. 1*b*. The release member 18 is located on the outside face of the side wall 1*b* of the cassette 1 and has at its leading end a cam face 18*a* which, when the cassette 1 advances for installation, depresses the roller 16*b* on the latch lever 16 and swings the lever 1*b* clockwise to release the retracting member.

The click means M for locking the cassette 1 in position includes a locking roller 19 mounted on the apparatus main body and being shiftable perpendicular to the side wall 1*b* of the cassette 1 and biased toward the cassette, and a positioning cam 20 is located on the outside face of side wall 1*b* forward of release. Immediately before the cassette 1 abuts the stop 4, the roller 19 on a projecting portion of the cam 20 comes into engagement with a slanting face 20*a* of the cam. Upon the cassette 1 abutting the stop 4, the roller 19 is advanced into pressing engagement with the cassette side wall 1*b* and the slanting face 20*a* to lock the cassette in position with a click.

In brief, the cassette 1 according to the present embodiment, is fixedly provided on the outside face of its side wall 1*b* with the depressing member 15 for activating the member 14 to retract the lifting member 6, the release member 18 for activating the latch lever 16 for holding the retracting member 14 in its retracted position to release the retracting member, the cam 20 for positioning the cassette, and the selecting member 13 for indexing the spring adjusting member 12. Among these members, the cam 20 and the cam face 18*a* of the release member 18 are accurately located in such relation that when the locking roller 19 moves from the raised portion of the cam 20 into engagement with the slanting face 20*a*, the roller 16*b* on the latch member 16 reaches the lower end of the cam face 18*a* of the release member 18 to release the retracting member 14 immediately before the cassette 1 is locked in its installed position by the click means M.

Figure 5B:
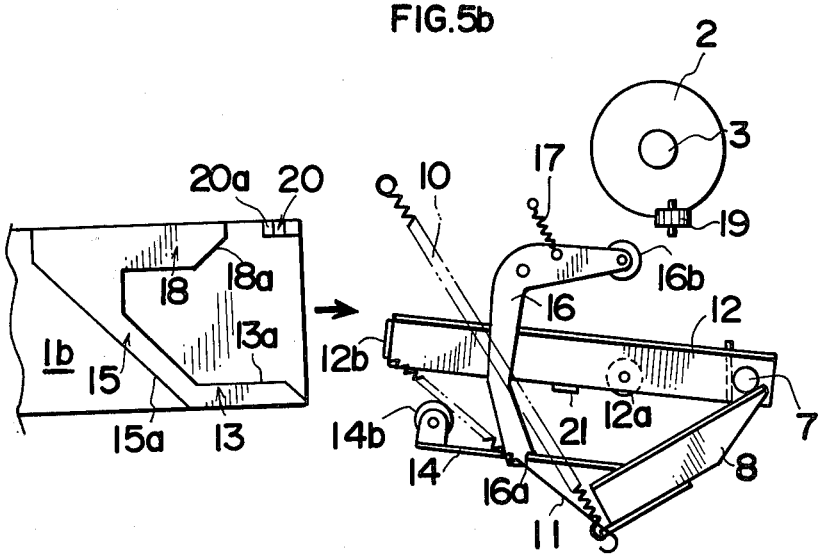
FIG. 5*b* is a side elevational view thereof.

While the apparatus is not loaded with a cassette, the spring adjusting member 12 is retained by a holding member 21 to underlie member 12 in such a position that the roller 12*a* can ride on the cam face of the selecting member 13 or 13' as seen in FIG. 5*b*.

Considering now the operation of the mechanism described above, when a cassette 1 accommodating sheets P1 of small size is inserted into the unloaded apparatus as shown in FIG. 5*b*, as the cassette is advanced into the apparatus in the direction of the arrows, the roller 12*a* on the spring adjusting member 12 rides onto the cam face 13*a* of the selection member 13 immediately before the cassette is in its fully inserted position, whereby the adjusting member 12 is brought to a controlled or indexed first position as shown in FIG. 1*b*. In this position, the secondary spring 11 is untensioned or disabled and held out of operation because the cam face 13*a* is at a low level. The cam face 18*a* of the release member 18 depresses the roller 16*b* on the latch lever 16, swinging the latch lever 16 clockwise as viewed in FIG. 5*a* and releasing the retracting member 14 from the engaging portion 16*a*, whereupon the primary spring 10 acts to raise the lifting member 6 from its retracted position. The member 6 engages and raises the paper support plate 5 which thereby presses the first or uppermost sheet P1 against the feed rollers 2.

In response to a feed signal, the feed rollers 2 in this first sheet engaging condition rotate, successively feeding individual sheets P1 from the uppermost position of the sheet stack under a proper feed pressure. When all the sheets have been fed and the sheets are depleted, the apparatus is in the condition shown in FIGS. 2*a* and *b*.

Figure 2B:
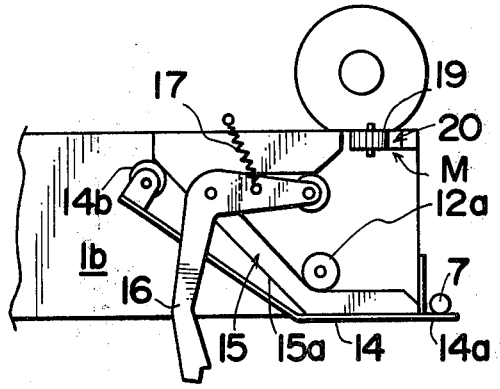
FIG. 2*b* is a fragmented side elevational view of the mechanism in the condition of FIG. 2*a;*

The cassette 1 is then retracted and removed from the apparatus. This retraction movement causes the cam face 15*a* of the depressing member 15 to depress the roller 14*b* on the retracting member 14, consequently retracting the lifting member 6 from the path of insertion of the cassette 1. Moreover, with the retraction of the cassette, the cam face 18*a* of the release member 18 frees the roller 16*b* on the latch lever 16, which in turn swings counterclockwise as viewed in FIG. 2*b* under the influence of the spring 17 and releaseably locks the retracting member 14 in its retracted position. The cam face 13*a* of the selection member 13 also releases the roller 12*a* of the spring adjusting member 12. The apparatus is now again in the condition shown in FIG. 5*b*.

Considering now the operation of the improved mechanism when a cassette containing or accommodating sheets P2 of large size is inserted into the apparatus, as seen in FIG. 3*b*, the selecting member 13' provided on such cassette 1 for controlling the roller 12*a* on the spring adjusting member 12 has its cam face 13'*a* positioned at a relatively high level, so that as the cassette is inserted into the apparatus to an operative position, the spring adjusting member 12 is advanced to another controlled, spring, enabling, position shown in FIG. 3*a* immediately before the cassette reaches its fully inserted position to thereby tension the secondary spring 11. The lifting member 6, consequently biased by both the primary spring 10 and the secondary spring 11, lifts the paper support plate 5 and presses the uppermost sheet P2 against the feed rollers 2, thereby assuring a predetermined proper feed pressure. The same operational sequence as is the case with the lighter sheets P1 is thereafter repeated.

Since the selection member for the spring adjusting member is provided on the cassette according to the embodiment of the present invention described above, the biasing force suitable for sheets of any particular size to be used is selectively available automatically upon the charging of the cassette into the apparatus.

Although the embodiment herein specifically described is adapted for use with paper sheets of difference weights due to the differences in size, the embodiment is similarly useful for paper sheets of the same size but different in weight owing to the difference in the quality or density of the paper. Furthermore, the feed pressure is also similarly adjustable when paper support plates of different weights are used.

The foregoing mechanism is so controlled that the secondary spring is made to cooperate with the primary spring to obtain the proper feed pressure for the sheets P2 of large size, namely, of large weight. Conversely, the same results are achievable by setting the force of the primary spring for the sheets P2 of large size to give the proper feed pressure and causing the secondary spring to act in a direction opposite to the primary spring to obtain the proper feed pressure for the smaller sheets P1. This can be achieved by making a simple modification to the foregoing arrangement, for example, by arranging the spring adjusting member 12 and spring holder 8 in a reverse relation to the above and providing the selecting members 13 and 13' with their cam faces down.

Alternatively, a single spring as provided between the spring adjusting member 12 and the spring holder 8 can be controlled to give the proper feed pressure to sheets of different sizes by using suitably shaped selecting members 13 and 13' and thereby shifting the spring adjusting member 12.

Needless to say, the various control methods mentioned can be combined to provide suitable biasing means for assuring the proper feed pressure for sheets of three or more different parameters, that is, size, density or any dimension that varies the downward force of the stack of sheets per unit height of the stack.

Although the selecting member for controlling the position of the spring adjusting member 12 is provided on the cassette in the embodiment described, the selecting member may alternatively be provided on the main body of the apparatus. In this case, the selecting member may be made movable from outside, with the spring adjusting member 12 rendered selectively shiftable by one member between the position shown in FIG. 1*a* and that shown in FIG. 3*a*. Furthermore, the spring adjusting member can be made directly shiftable by a lever when the adjusting member 12 is connected to a selection member which is operable from outside or an extension of the adjusting member may be externally operable.

In summary, the improved mechanism described above, has the advantage that the force of the paper stack support plate biasing means is controlled by operating the control member through the selection means to provide an optimum predetermined feed pressure for cassettes accommodating sheets of different weights per unit thickness and assure a proper feeding operation even when such cassettes are used. The cassettes having the selection means thereon are highly useful in that the proper feed pressure is available when the cassette is inserted into operative position, without necessitating an additional procedure therefor.

While there have been described and illustrated preferred embodiments of the present invention, it is apparent that numerous alterations, omissions and additions may be made without departing from the spirit thereof.

I claim:

1. A paper feed mechanism comprising a feed roll, an interchangeable cassette including a support member disposed in said cassette and supporting a stack of paper sheets for upward movement, biasing means urging said stack upwardly to advance the uppermost sheet of said stack into feed engagement with said feed roll and means for adjusting said biasing means including an indexing member disposed on said cassette in accordance with the weight per unit height of the paper contained therein and means responsive to the disposition of said indexing member for varying said biasing means whereby to regulate the pressure of said uppermost sheet on said feed roll to a substantially constant predetermined value.

2. The paper feed mechanism of claim 1, wherein said biasing means includes spring means upwardly urging said support member and said adjusting means includes means for varying the strength of said spring means.

3. The paper feed mechanism of claim 2, wherein said spring means includes a first spring member normally acting on said support member and a second spring member selectively enabled in accordance with the disposition of said indexing member.

4. The paper feed mechanism of claim 1, wherein said cassette includes a bottom wall having an opening therein and said indexing member is disposed in accordance with the size of the paper sheets contained in the cassette, said support member includes a plate swingable about its trailing edge, said biasing means includes a lift member projecting through said bottom wall opening and engaging said swingable plate and spring means upwardly biasing said lifting member and said adjusting means is responsive to said indexing member to vary the biasing of said lifting member as a direct function of the size of the sheets contained in the cassette.

5. The paper feed mechanism of claim 4, wherein said spring means includes a first spring member operatively coupled to said lift member and a second spring operatively coupled to and uncoupled from said lift member in response to the disposition of said indexing member.

6. In a paper feed apparatus which is loadable with a cassette which is interchangeable with another cassette, said cassette having a paper support plate in its main body accommodating sheets of paper as stacked on the support plate and in which the paper support plate is liftable to press the stack of sheets against feed rollers, the improvement comprising:

a lifting member for lifting the paper support plate;

biasing means including a spring member for providing a lifting force to the lifting member, and adjusting means for varying the force of the biasing means and including cam members provided on each cassette and engageable with said spring member when a respective cassette is loaded the sizes of the cam members being different from each other in accordances with differences in the weight of the stack of sheets on the paper support plate.

* * * * *